US005779125A

United States Patent [19]

Melzer et al.

[11] Patent Number: 5,779,125

[45] Date of Patent: Jul. 14, 1998

[54] SYSTEM FOR PROCESSING A WEB OF PLASTIC MATERIAL

[75] Inventors: Rainer Melzer; Roland Melzer, both of Schwelm, Germany

[73] Assignee: Melzer maschinebau GmbH, Schwelm, Germany

[21] Appl. No.: 751,301

[22] Filed: Nov. 15, 1996

[30] Foreign Application Priority Data

Nov. 18, 1995 [DE] Germany ..... 195 43 140.5

[51] Int. Cl.[6] ..... G03B 1/28; G03B 1/34

[52] U.S. Cl. ..... 226/55; 226/87

[58] Field of Search ..... 226/34, 55, 87, 226/2, 27; 198/345.1, 345.3; 52/223.12

[56] References Cited

U.S. PATENT DOCUMENTS

| | | | |
|---|---|---|---|
| 3,428,395 | 2/1969 | Mitchell | 226/55 X |
| 3,794,415 | 2/1974 | Jones | 226/55 X |
| 3,998,369 | 12/1976 | Grosjean et al. | 226/87 X |

*Primary Examiner*—Michael Mansen

*Attorney, Agent, or Firm*—Townsend and Townsend and Crew LLP

[57] ABSTRACT

In a system for processing a plastic web plural work stations are disposed on an elongated beam. The web is provided with positioning holes cooperating with complementary pins in at least one work station. As the distance spacing allocated holes may vary due to shrinking, the beam may be bent about a transverse axis into a ring sector shape thereby adapting the pin distances to the actual hole distances.

9 Claims, 1 Drawing Sheet

SYSTEM FOR PROCESSING A WEB OF PLASTIC MATERIAL

BACKGROUND OF THE INVENTION

The present invention relates to a system for processing a web of plastic material comprised of "articles" separated by a punch grid. The articles may be e.g. plastic cards, as credit cards, telephone cards, or so-called smart cards having an embedded chip. When processing such webs, extreme accuracy requirements must be met. For this reason, the web may be provided with positioning holes punched into transverse straps of the punch grid. The holes mate with positioning pins provided in the individual processing stations so as to present the individual "articles" in proper registration.

Frequently, such cards are manufactured by laminating a plurality of films, the positioning holes then being utilized to bring the films together in proper alignment and registration and to guide them through the laminating apparatus. The films are heated and pressed in the laminating apparatus and then cooled down. A web so produced undergoes a shrinking process thereby varying the spacing which separates the positioning holes. Even if the shrinking of, say, a few tenths of a millimeter for a card having a standard length of 86 millimeters is in the range of tenths percent, this affects nevertheless the processing. Under certain conditions, a number of e.g. ten cards ("articles") may be present between two successive positioning pins while the holes in between are not utilized; the shrinking may then be great enough that the capturing range of the pins is exceeded.

There would be an obvious remedy to the problem discussed above, that is, to adapt the pin distance to the shrunk distance of the web holes. However, this approach is not practical because the shrinking varies depending upon the material and may even vary when a fresh batch of one of the films is processed and even when it is supplied by the same supplier.

Conventionally, the individual work stations of a processing unit through which the web travels are arranged on an elongated support, and the positioning pins are provided in each such station.

SUMMARY OF THE INVENTION

It is an object of the invention to provide such a unit or system wherein the distances spacing the pins can be easily and simply adapted to varying shrink dimensions.

Instead of individually adjusting each pair of cooperating pins, according to the invention the adjustment is performed simultaneously for all pins, preferably by elastically deforming the entire support of the work stations.

DESCRIPTION OF THE SPECIFIC EMBODIMENTS

Figure 1:
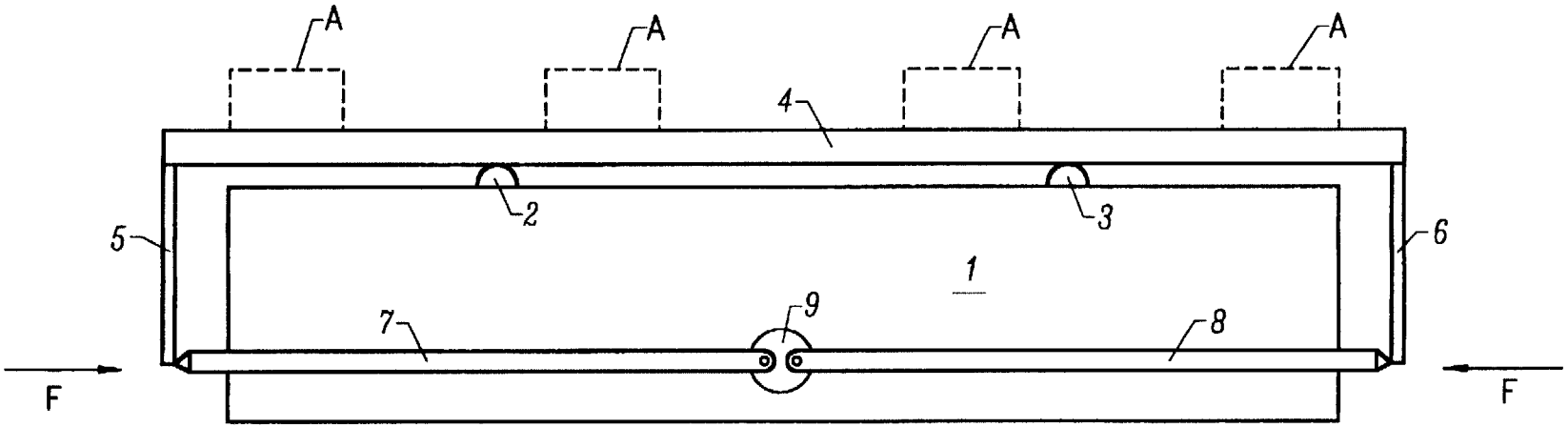
FIG. 1 is a schematic representation of a system constructed in accordance with the principles of the present invention.

According to the present invention, a support may be a beam sufficiently solid and stiff to carry all the work stations. When producing chip cards, those stations may include a milling station where recesses are milled into the card, a further station where glue is dispensed into the recess, a still further station where a chip is placed into the recess, and so on. An elastic deformation of the beam by stretching does not appear a practical means of adjustment. In a preferred embodiment of the invention, therefore, the beam is bent about an axis extending perpendicular to the conveying direction (i.e. transverse to the longitudinal axis) of the web through the stations. The bending forces are substantially smaller than those which would be needed for linear stretching. Upon bending, the length of the center line (longitudinal axis) does not vary, but the upper side of the beam is stretched while its lower side is compressed, provided the bending center is below the beam. Thus, the pin distances of the work station mounted on top of the beam are increased upon bending. Preferably, the geometry of the bending apparatus is adapted to the geometry of the beam such that the latter is bend—at least approximately—into the shape of a circular ring sector whereby the pin distances of all work stations are regularly increased.

In a preferred embodiment of the invention, the (originally) horizontal beam is placed on two supporting elements which in turn are disposed on a base frame. At both ends of the beam, depending legs are mounted, the free ends of the legs being subjected to forces tending to bend the beam about a transverse axis. Preferably, links are connected to the leg ends and extend towards one another. The inner ends of the links are connected to a power driven crank. Preferably, links are pivotably connected to the leg ends and extend towards one another. The inner ends of the links are connected to a power driven crank. Preferably, at the inlet end of the system, the distance spacing successive pin holes is measured and the crank position is selected to adapt the beam to the measured values.

The attached drawing is a schematic side view of the installation in question, the appliances A for the various work stations shown in broken line. An adjustable support frame comprises two bearing brackets 2, 3 mounted on a base 1. An adjustable beam 4 is loosely supported by brackets 2, 3. Depending legs 5, 6 are mounted on the ends of beam 4. In front of base frame 1 (or behind it, or in front and behind) links 7, 8 are pivotably coupled respectively to legs 5 and 6. The other ends of links 7 and 8 are pivotably coupled to crank 9. Crank 9 is mounted on the driven output shaft of gear means driven by a motor, not shown. By pivoting crank 9, pull forces are transmitted to legs 5, 6 via links 7, 8 (in the directions shown by arrows F), and converted into bending torque acting on beam 4. Such bending torque will longitudinally stretch the upper surface of the beam 4, acting to increase the distance between appliances A. By adjusting the distances between stations by an appropriate amount, spacing of the pins can be corrected by a proper amount.

What is claimed is:

1. A system for affixing a plastic web upon a longitudinally extending beam, the plastic web comprising successive articles separated by transverse straps of a punch grid, said transverse straps being provided with longitudinally spaced-apart positioning holes thereon, the longitudinally extending beam being provided with longitudinally spaced-apart positioning pins thereon, wherein the longitudinally spaced-apart positioning holes are dimensioned to mate with the longitudinally spaced-apart positioning pins, comprising:

means for simultaneously adjusting a separation distance between the spaced-apart positioning pins on the beam by bending the beam about an axis extending transversely therethrough.

2. The system of claim 1 wherein said means are adapted to elastically deform said beam.

3. The system of claim 1 wherein said beam has two supporting elements positioned thereunder, and two legs extending therefrom, each leg being fixed at an opposite longitudinal end of said beam.

4. The system of claim 3 further comprising:

a first and second link each having a first and a second end, the first ends being coupled to a first leg and the second ends being coupled to a common power driven crank.

5. The system of claim 4 wherein the separation distance is controlled by bending the beam by pivoting the first and second links by rotating the power driven crank.

6. The system of claim 3 wherein positions of said supporting elements and dimensions of said legs are selected such that said beam is bent to assume a shape of a ring sector.

7. A system for positioning a plastic web upon a beam, the plastic web comprising successive articles separated by transverse straps of a punch grid, wherein said straps have longitudinally spaced-apart positioning holes therein which are dimensioned to mate with longitudinally spaced-apart positioning pins on the upper surface of a beam, the improvement comprising:

an adjustable support frame coupled to the beam, wherein the support frame can be selectively adjusted to bend the beam about a transverse axis of the beam to change the distance between the positioning pins on an upper surface of the beam.

8. The system as in claim 7, wherein the support frame comprises a first and second leg extending vertically from the beam, a link spanning between and connected to each of said first and second legs, and a crank for pivoting the links relative to the beam, thereby causing said beam to bend.

9. A method for adjusting the relative longitudinal position of a plurality of spaced-apart positioning pins on a surface of a beam adapted for processing a plastic web comprising successive articles separated by transverse straps of a punch grid, wherein said straps have positioning holes which mate with the positioning pins, said method comprising:

bending the beam about a transverse axis to adjust the length of the surface of the beam which carries the pins.

* * * * *